US005125563A

United States Patent [19]

Lombardo

[11] Patent Number: 5,125,563

[45] Date of Patent: Jun. 30, 1992

[54] FLIP WINDOW FOR MULTIPLE RETURN ADDRESS

[75] Inventor: Leo Lombardo, Manchester, N.H.

[73] Assignee: Moore Business Forms, Inc., Grand Island, N.Y.

[21] Appl. No.: 737,040

[22] Filed: Jul. 29, 1991

[51] Int. Cl.[5] ..... B65D 27/04

[52] U.S. Cl. ..... 229/71; 229/314

[58] Field of Search ..... 229/71, 314, 316

[56] References Cited

U.S. PATENT DOCUMENTS 4,239,114 12/1980 Denay ..... 229/314

4,799,618 1/1989 Jenkins ..... 229/71

*Primary Examiner*—Stephen Marcus

*Assistant Examiner*—Jes F. Pascua

*Attorney, Agent, or Firm*—Nixon & Vanderhye

[57] ABSTRACT

An intermediate for a business form can be constructed into a mailer type business form that allows variable return address and addressee information to be printed at the same time that the inside of the mailer is printed. First and second die cut windows are formed in a sheet of paper, with a first flap having a longitudinal edge integral with the paper and adapted to pivot to fill the first die cut window. A second flap is attached to the first, and overlaps it to such an extent that it can be pivoted with the first flap to overlie the second window. The flaps are pivoted inwardly and then printed at the same time that the inside of the mailer is printed, with variable return address information printed on the first flap, and addressee information printed on the second flap portion adapted to overlie the second window. A transparent patch may cover the second window, and the second flap may be adhesively secured in place in contact with the transparent patch. The paper is folded about a center line with both windows on the same side of a center line, and connected at the edges by adhesive strips to form a mailer, with the flaps disposed between the top and bottom plies of the mailer.

18 Claims, 3 Drawing Sheets

Fig. 1
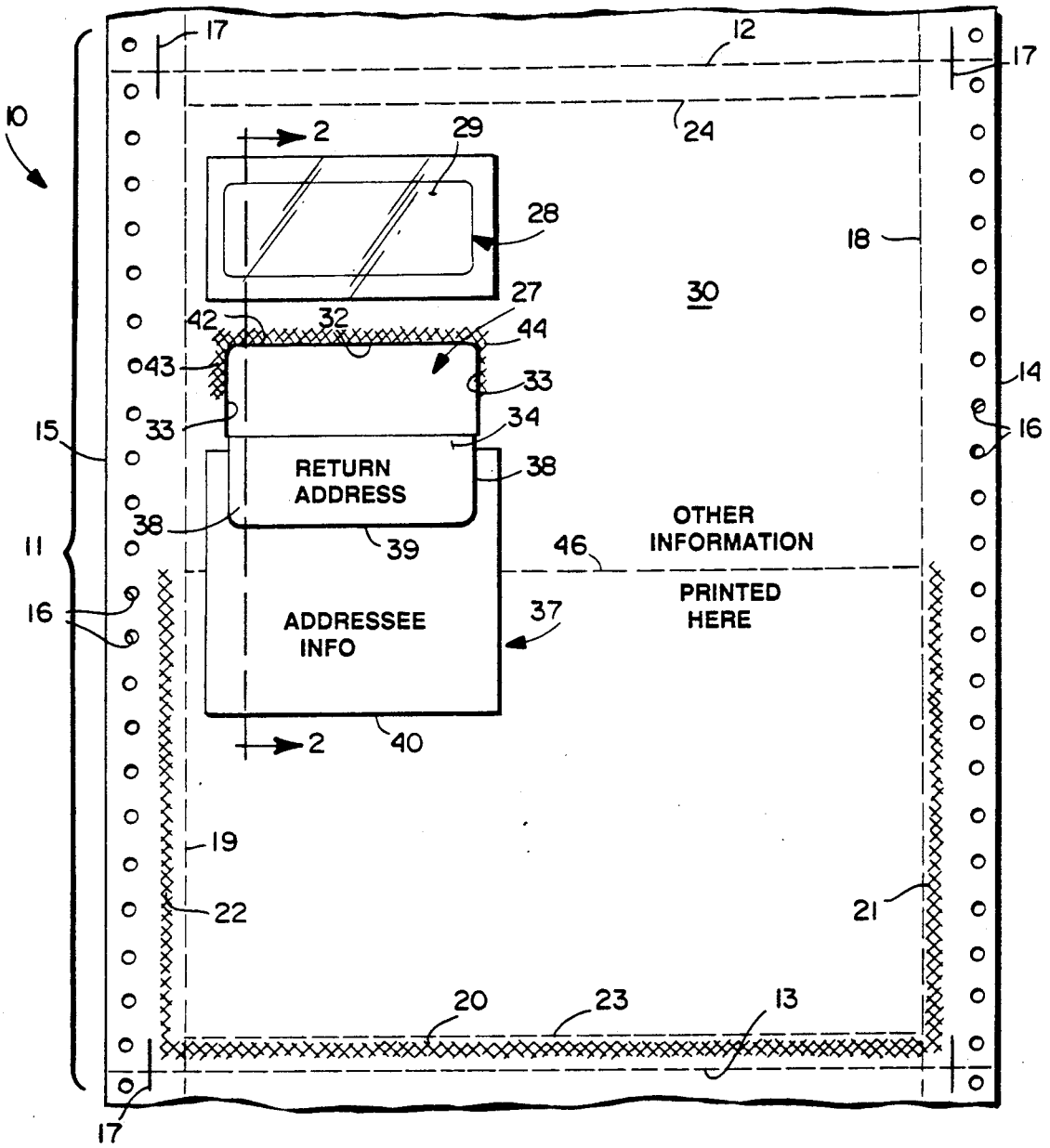
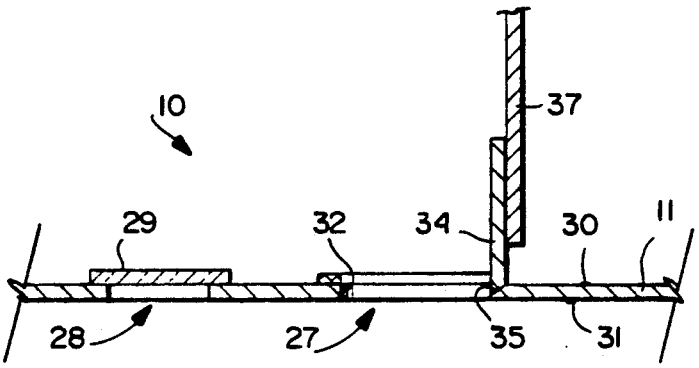
Fig. 2

FLIP WINDOW FOR MULTIPLE RETURN ADDRESS

BACKGROUND AND SUMMARY OF THE INVENTION

There are a number of mailer type business forms in which it is desirable to be able to provide variable return address information, as well as variable addressee information. In the manufacture of a number of different types of mailers, including two ply mailers, it is not efficient to have to print both faces of the mailer. Rather it is desirable to print only one face, and to print the return address and addressee information at the same time that the interior face of the mailer is being printed.

According to the present invention, an intermediate mailer type business form, final mailer, and method of making a mailer type business form, are provided that allow the above stated objective to be achieved. This objective is achieved without the problems inherent in prior art constructions that used two windows and two separate die cut flaps, one associated with each of the windows. Such prior art constructions are difficult to effectively print and handle, essentially doubling the problems associated with conventional "flip" window constructions. According to the present invention, a mailer meeting the above stated goals can be produced with only the difficulties normally associated with a single flip window mailer, thus providing significant advantages over the prior art constructions obtaining that same end result.

According to one aspect of the present invention, an intermediate business form for constructing a mailer type business form is provided. The intermediate according to the invention comprises: A flexible sheet having first and second parallel edges, and third and fourth parallel edges, the third and fourth edges perpendicular to the first and second edges. First and second windows in the sheet, each having longitudinal and side edges, side edges. A first, relatively small, flap affixed to the sheet and movable to a position substantially filling or blocking the first window. And, a second, relatively large, flap, the second flap connected to the first flap, and movable with the first flap to substantially fill or cover the second window. The windows are preferably vertically aligned, and the second flap overlaps the first flap and is held in place, covering the second window, with an adhesive strip. A transparent patch is preferably disposed over the second window, on the inside of the completed mailer. The mailer is formed by folding the sheet about a center line (e.g. perf line) parallel to the longitudinal edges of the windows, and adhesive strips are provided attaching the mailer portions together at their edges. Variable return address information is typically printed on the first flap, while addressee information is printed on the second flap.

According to another aspect of the present invention a mailer is provided. The mailer comprises: A top sheet and a bottom sheet, with adhesive strips connecting the top and bottom sheets together along at least one edge thereof. First and second die cut windows formed in the first sheet having long edges which are parallel to a first edge of the first sheet. Flap means having a first edge parallel to the longitudinal edge of one of the windows, and pivotal about that edge to a position substantially filling or covering both the first and second windows. First address indicia printed on the flap means at a portion thereof adapted to substantially fill or overlie the first window; and second address indicia printed on the flap means at a portion thereof adapted to substantially fill or overlie the window means. The flap means preferably comprise first and second flaps adhesively connected together.

The invention also comprises a method of making a mailer, the method comprising the steps of: (a) Forming first and second aligned die cut windows in the web, the first die cut window including a first flap having an edge integral with an edge of the window, the first flap pivotal about its first edge. (b) Affixing a second flap, having dimensions significantly greater than the first flap, and great enough to overlie the second window when the first flap is pivoted to a position substantially filling the first window, to the first flap. (c) Bending the flaps about the integral edge of the first flap so that they extend parallel to the web but do not overlie or fill the windows. (d) Printing the web face that the flaps overlie while at the same time simultaneously printing address information on both webs. (e) Pivoting the flaps to a position wherein the first flap substantially fills the first window and the second flap overlies the second window. And, (f) constructing the web into a mailer.

It is the primary object of the present invention to provide a mailer which can have variable information printed for both the return address and the addressee, while avoiding the complications of two flip windows. This and other objects of the invention will become clear from an inspection of the detailed description of the invention, and from the appended claims.

BRIEF DESCRIPTION OF THE DRAWINGS

FIG. 1 is a top plan view of a continuous intermediate business form according to the invention, with the flaps thereof bent inwardly to be printed at the same time as the interior of the form;

FIG. 2 is a cross-sectional view, taken along lines 2—2 of FIG. 1, of the intermediate form of FIG. 1, and showing the flaps extending upwardly, during movement between their two folded over positions;

DETAILED DESCRIPTION OF THE DRAWINGS

Figure 3:
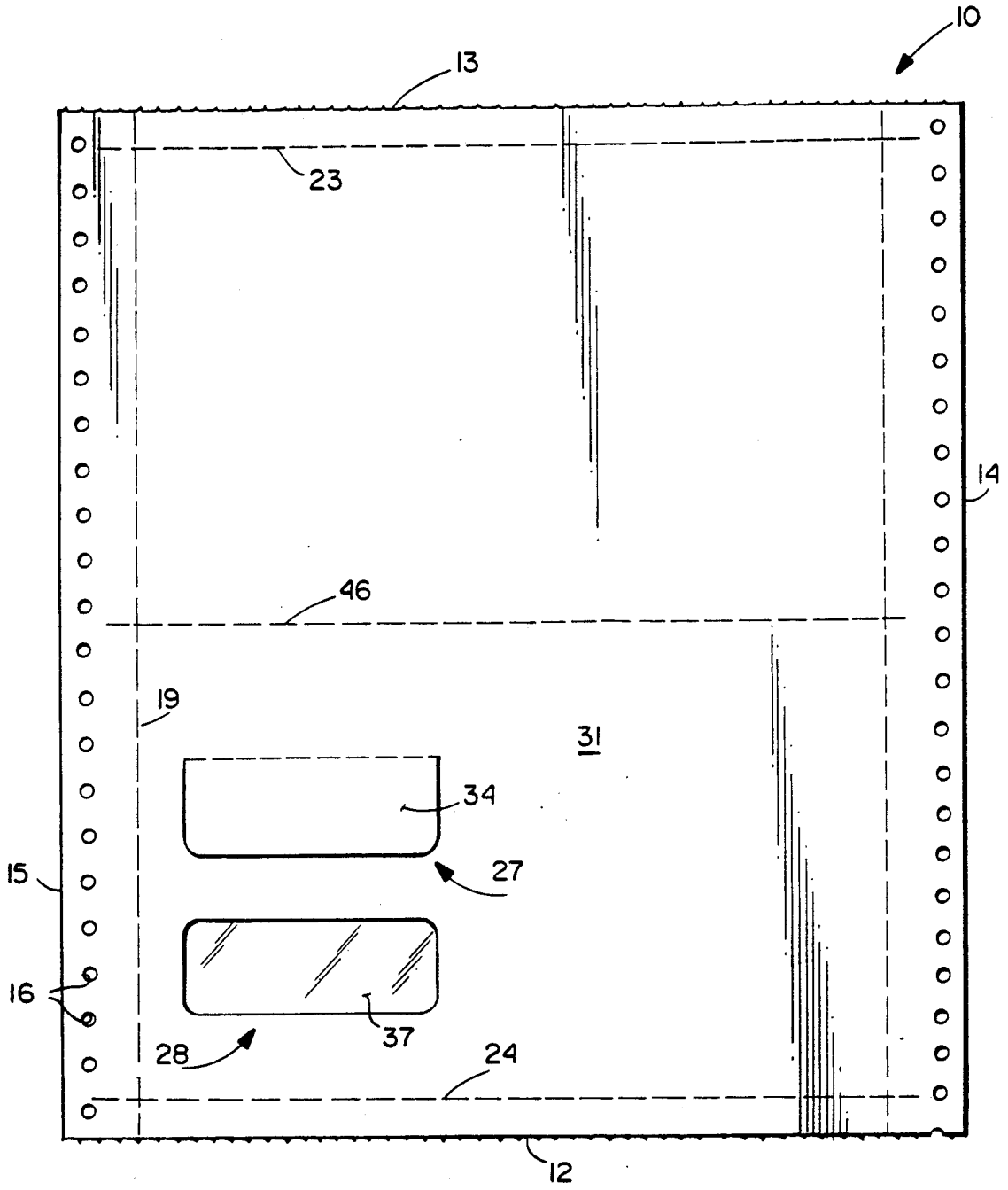
FIG. 3 is a view like that of FIG. 1 only showing the opposite face of the intermediate form, and with the flaps folded into place substantially filling or covering the windows.

An exemplary intermediate business form according to the invention is shown generally by reference numeral 10 in FIGS. 1 through 3. The intermediate business form 10 comprises a sheet of paper 11 that is attached, on both ends thereof, to like sheets of paper, to provide a continuous format. The sheet of paper 11 has first and second end edges 12, 13, and first and second side edges 14, 15. The edges 12, 13 are formed by perforations so that each sheet 11 is readily disconnected from the other sheets 11 continuous therewith. Along the side edges 14, 15 are a plurality of tractor holes 16 for driving the form 10 during construction. Slitter lines 17 are provided for alignment with slitters which cut off the tractor holes 16 at an appropriate stage during processing.

The sheet 11 also has provided therein, as is conventional per se in mailers, perf lines 18, 19 parallel to the edges 14, 15 respectively and inside of the tractor drive holes 16, which facilitate opening up of the completed form by the end user. Adhesive strips 20, 21, 22, respectively are provided adjacent the edges 13, 14, and 15—preferably only extending half way up the edges 14, 15—for connecting the form components together. The adhesive strips 21, 22 are disposed between the perf lines 18, 19 and the slitter marks 17. Disposed interiorly of the glue line 20, spaced from the edge 13, is another perf line 23, and a similar perf line 24 is provided spaced from the end edge 12.

According to the present invention, a pair of die cut windows, comprising a first die cut window shown generally by reference numeral 27, and a second die cut window, shown generally by reference numeral 28, are provided. Typically a transparent material (e.g. glassine) patch 29 is disposed over the second die cut window 28 on the inner face 30 of the sheet 11, opposite the outer face 31 (see FIG. 3). The die cut window 27 has a completely severed longitudinal edge 32, and side edges 33, but the fourth (longitudinal) edge thereof is defined by a first flap 34, having a portion 35 (which may be a perf line) thereof integral with the sheet 11 and defining a longitudinal edge of the first window 27 opposite the longitudinal edge 32.

According to the invention a second flap is also provided, as indicated by reference numeral 37. The second flap 37, which can comprise a #24 patch, is affixed—as by adhesive—to the back side of the first flap 34, and the second flap 37 has dimensions which overlap the first flap 34 both at the sides 38 thereof, and at the non-attached end 39 thereof. As a matter of fact, the edge 40 of the second flap 37 is spaced from the edge 39 a distance sufficient so that the flap 37 can completely overlie the second die cut window 28 (and the glassine patch 29 disposed thereover).

The flaps 34, 37 and face 30 of sheet 11, are printed at the same time, in the position as illustrated in FIG. 1. After printing of variable information on the flaps 34, 37, they are pivoted to the position—seen in FIGS. 3 and 4—in which the first flap 34 substantially fills the first die cut window 27, and the second flap 37 overlies the second die cut window 28. In this position the flaps are preferably held in place by adhesive strips, such as the adhesive strips 42, 43, 44 along the edges 32, 33 of the first die cut window 27.

Figure 4:
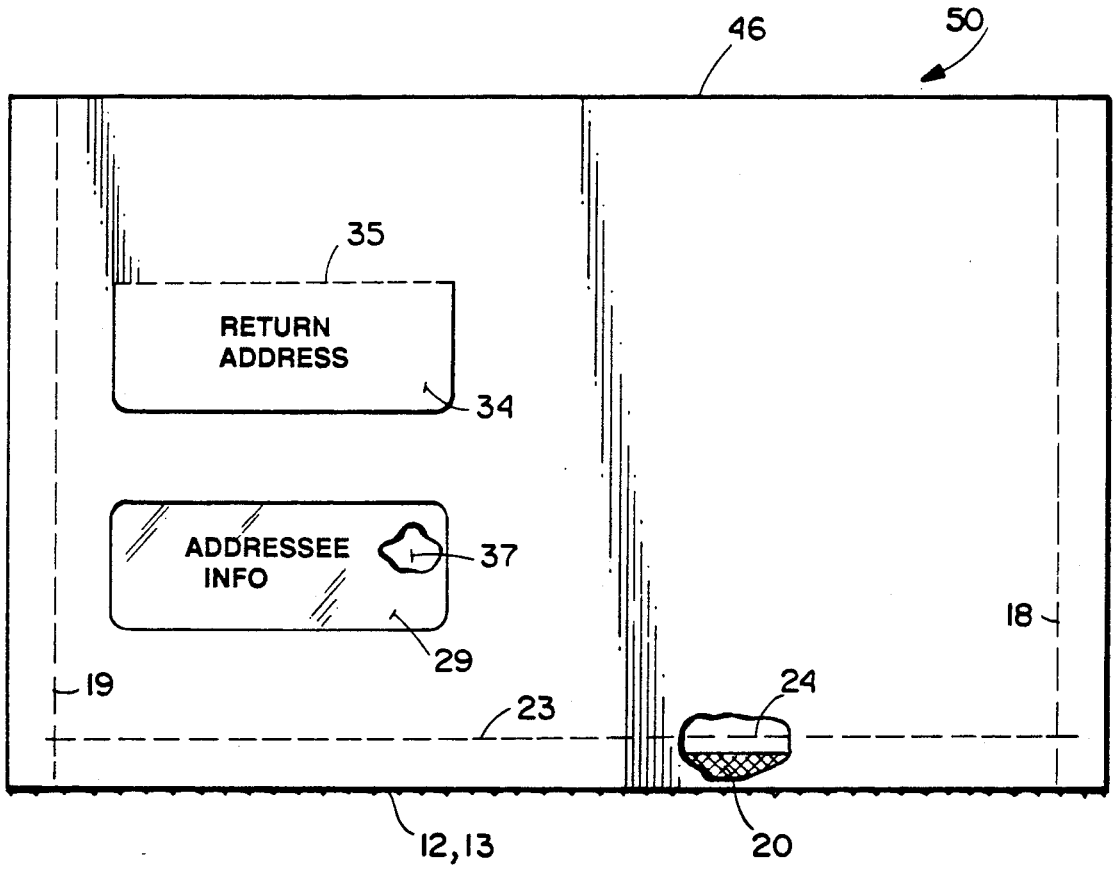
FIG. 4 is a plan view of a completed mailer according to the invention as sent out to an addressee.

After processing, a mailer 50 is formed from the sheet 11 by folding the sheet 11 in half, about the center line 46 thereof, which preferably is a perf line, and the adhesive strips 20–22 are activated, to produce the completed mailer 50 (see FIG. 4).

The mailer 50 is preferably constructed in the following manner:

The continuous sheets of paper 11 are acted upon to form the various perf lines 12, 13, 18, 19, 23, and 24, and they have the glue strips 20–22 and 42–44 applied thereto (to face 30). Also the die cut windows 27, 28 are formed therein, the glassine patch 29 applied, and the second flap 37 adhesively connected to the first flap 34. Then the intermediate form 10—in the configuration illustrated in FIG. 1—is passed through a printer, such as a non-impact printer, which prints any desired information on the inside face 30, prints variable return address information on the first flap 34, and prints the addressee information on the portion of the second flap 37 that will overlie the second die cut window 28 in the completed form.

After the above printing operation has taken place—in which all of the variable information is printed at once—the tractor holes 16 are separated from the rest of the form 10 by slitting along the slit line 17; the sheet 11 is detached along the perforations 12, 13 from the like sheets on opposite sides thereof; the flaps 34, 37 are folded over to the position illustrated in FIGS. 3 and 4 in which the flap 34 fills the first window 27 and the second flap 37 overlays the second window 28; the sheet 11 is folded about its center line (perf) 46 so that the face 30 is to the inside and the face 31 is on the outside, and the second flap 37 is between the folded over portions; and then the adhesive associated with the strips 20–22 and 42–44 is activated. This produces the mailer 50 with the variable return address in alignment with but spaced from the addressee information readable through the glassine patch 29.

It will thus be seen that according to the present invention a mailer with variable return address information may be printed which avoids the disadvantages of a double flip window construction. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and methods.

What is claimed is:

1. An intermediate of a business form, formable into a mailer, comprising:

a flexible sheet having first and second parallel edges, and third and fourth parallel edges, the third and fourth edges perpendicular to the first and second edges;

a pair of windows in said sheet, comprising first and second windows, each having longitudinal and side edges;

a first flap, having a first size, affixed to said sheet and movable to a position substantially filling or blocking said first window; and a second flap, having a second size greater than said first size, said second flap connected to said first flap, and movable with said first flap to substantially fill or cover said second window.

2. An intermediate as recited in claim 1 wherein said first flap has a longitudinal edge thereof connected to and integral with said sheet at a longitudinal edge of said first window.

3. An intermediate as recited in claim 2 wherein said second flap is attached with adhesive to said first flap for movement therewith.

4. An intermediate as recited in claim 2 wherein said first and second windows are spaced from each other, and aligned with each other, in a dimension perpendicular to said longitudinal edge attachment of said first flap to said first window.

5. An intermediate as recited in claim 2 wherein said second flap overlaps said first flap at side edges thereof, and overlaps the side edges of said first window.

6. An intermediate as recited in claim 5 further comprising at least one adhesive strip formed adjacent an edge of said first window for affixing said second flap to said flexible sheet when said adhesive strip is activated.

7. An intermediate as recited in claim 1 wherein said second window has a transparent patch permanently affixed to said flexible sheet and extending thereacross.

8. An intermediate as recited in claim 1 wherein said flexible sheet has a center fold line, and wherein said first and second windows are disposed on the same side of said center fold line and have the longitudinal edges thereof parallel to said center fold line.

9. An intermediate as recited in claim 8 further comprising first, second, and third adhesive strips formed adjacent said second, third, and fourth edges of said flexible sheet, on one side of said fold line, for attaching the portions of said flexible sheet on the opposite sides of said fold line together when said flexible sheet is folded about said fold line.

10. An intermediate as recited in claim 9 further comprising perforations formed at said second, third, and fourth edges adjacent, and interior of, said adhesive strips.

11. An intermediate as recited in claim 10 wherein said fold line comprises a perforation.

12. An intermediate as recited in claim 1 further comprising return address indicia printed on said first flap, and recipient address indicia printed on said second flap at a portion thereof alignable with said second window.

13. An intermediate as recited in claim 1 wherein said second flap is a number 24 patch.

14. An intermediate as recited in claim 1 wherein said first flap has a first edge about which it is pivotable and wherein said first and second windows are spaced from each other, and aligned with each other, in a dimension perpendicular to said first edge.

15. An intermediate as recited in claim 1 wherein said second flap overlaps said first flap at side edges thereof, and overlaps the side edges of said first window.

16. A intermediate as recited in claim 1 wherein said first and second edges of said flexible sheet are connected to like intermediates, so as to provide a continuous intermediate business form.

17. A mailer comprising a top sheet and a bottom sheet, with adhesive strips connecting said top and bottom sheets together along at least one edge thereof;

first and second die cut windows formed in said first sheet having longitudinal edges which are parallel to a first edge of said first sheet;

a first flap having a longitudinal edge thereof integral with said longitudinal edge of said first window, said first flap for substantially filling said first window, comprising a die cut portion thereof; and a second flap adhesively attached to said first flap, and overlapping said first flap side edges, and movable to a position completely overlying said second window; and first address indicia printed on said first flap at a portion thereof adapted to substantially fill or overlie said first window, and second address indicia printed on said second flap at a portion thereof adapted to substantially fill or overlie said second window.

18. A mailer as recited in claim 17 wherein said second flap, when moved into a position overlying said second window, is adhesively secured in place by at least one adhesive strip on said first sheet, interior of said mailer.

* * * * *